US005344308A

United States Patent [19]

Cummings, III

[11] Patent Number: 5,344,308

[45] Date of Patent: Sep. 6, 1994

[54] COMBUSTION NOISE DAMPER FOR BURNER

[75] Inventor: William G. Cummings, III, Muncie, Ind.

[73] Assignee: Maxon Corporation, Muncie, Ind.

[21] Appl. No.: 53,717

[22] Filed: Apr. 27, 1993

Related U.S. Application Data

[63] Continuation-in-part of Ser. No. 792,720, Nov. 15, 1991, Pat. No. 5,236,350.

[51] Int. Cl.[5] ..... F23D 21/00

[52] U.S. Cl. ..... 431/114; 431/352

[58] Field of Search ..... 431/352, 114

[56] References Cited

U.S. PATENT DOCUMENTS

| | | | |
|---|---|---|---|
| 1,771,875 | 7/1930 | Cowardin et al. . | |
| 2,096,765 | 10/1937 | Saha . | |
| 2,276,131 | 3/1942 | Wiant . | |
| 2,294,168 | 8/1942 | Francis et al. . | |
| 2,485,207 | 10/1949 | Logan | 431/352 |
| 2,518,800 | 8/1950 | Lester . | |
| 2,594,312 | 4/1952 | Kerr et al. . | |
| 2,858,780 | 11/1958 | Sifrin et al. . | |
| 3,218,134 | 11/1965 | Walsh | 431/352 |
| 3,219,094 | 11/1965 | Lempa . | |
| 3,301,306 | 1/1967 | Finley et al. | 431/352 |
| 3,306,333 | 2/1967 | Mock | 431/352 |
| 3,368,604 | 2/1968 | Mutchler . | |
| 3,736,747 | 6/1973 | Warren . | |
| 3,881,863 | 5/1975 | Creuz | 431/352 |
| 3,915,619 | 10/1975 | Quigg et al. . | |
| 4,021,186 | 5/1977 | Tenner . | |
| 4,112,676 | 9/1978 | DeCorso . | |
| 4,144,019 | 3/1979 | Lyshkow et al. . | |
| 4,177,740 | 12/1979 | Lamb et al. . | |
| 4,379,689 | 4/1983 | Morck . | |
| 4,382,771 | 5/1983 | Carr . | |
| 4,385,490 | 5/1983 | Schirmer et al. . | |
| 4,400,151 | 8/1983 | Vatsky . | |
| 4,427,362 | 1/1984 | Dykema . | |
| 4,598,553 | 7/1986 | Saito et al. . | |
| 4,651,534 | 3/1987 | Stroem . | |
| 4,683,541 | 7/1987 | David . | |
| 4,690,635 | 9/1987 | Coppin . | |
| 4,828,487 | 5/1989 | Earl . | |
| 5,013,236 | 5/1991 | Khinkis . | |
| 5,236,350 | 8/1993 | Cummings et al. | 431/173 |

FOREIGN PATENT DOCUMENTS

| | | |
|---|---|---|
| 597392 | 5/1960 | Canada . |
| 1134956 | 4/1957 | France . |
| 869852 | 6/1961 | United Kingdom . |

*Primary Examiner*—Carroll B. Dority
*Attorney, Agent, or Firm*—Barnes & Thornburg

[57] ABSTRACT

A combustion noise suppression system for a combustor assembly includes a number of holes formed in the combustor housing at a distance from the location at which an air and fuel mixture is introduced into the housing and ignited to produce flame.

3 Claims, 1 Drawing Sheet

COMBUSTION NOISE DAMPER FOR BURNER

This is a continuation-in-part of copending U.S. Ser. No. 07/792,720, filed Nov. 15, 1991, titled CYCLONIC COMBUSTER NOZZLE ASSEMBLY, now U.S. Pat. No. 5,236,350 and assigned to the same assignee as this application.

BACKGROUND AND SUMMARY OF THE INVENTION

This invention relates to combustion noise dampers for use in burner assemblies.

A particularly troublesome characteristic of combustors is combustion screech, a persistent audible noise having a substantial amount of its acoustic power concentrated in a fundamental frequency and its overtones, all of which depend primarily upon the length of the combustor housing, generally a cylinder having a closed end at which a burner is mounted and an open end through which combustion products exit from the combustor.

A combustor housing typically is closed at one end and open at the other. The burner nozzle assembly is ordinarily mounted adjacent the closed end. In the burner components, combustion-supporting and promoting materials are mixed and injected into the combustor housing. An igniter ignites these, and a flame is established at or adjacent the closed end of the housing. The flame is the source of the combustion screech's acoustic power. The closed end of the housing is a displacement node and a pressure antinode of the screech waveform. The open end of the housing is at approximately a pressure node and a displacement antinode of the screech waveform. If the length of the housing is considered to be L, it will be appreciated that another displacement antinode and pressure node will lie at a distance approximately $\frac{1}{3}$ the length L of the housing, measured from the closed end.

An organ pipe provides a simple study of sound originating in a vibrating air column. If both ends of a pipe are open and a stream of air is directed against an edge, standing longitudinal waves can be set up in the pipe. The air column will then resonate at its natural frequencies $\omega_n$ of vibration, given by $$\omega_n = \frac{n}{2L} v, \; n = 1,2,3, \ldots$$

where v is the speed of the longitudinal waves in the column whose superposition can be thought of as giving rise to the vibrations, and n is the number of half wavelengths in the length L of the column. The fundamental and overtones are excited at the same time. In an open pipe the fundamental frequency corresponds approximately to a displacement antinode at each end and a displacement node in the middle. Hence, in an open pipe the fundamental frequency is v/2 L and all harmonics are present. In a closed pipe the closed end is a displacement node. The fundamental frequency is approximately v/4 L, which is one-half that of an open pipe of the same length. The only overtones present are those that give a displacement node at the closed end and an antinode (approximately) at the open end. Hence, the second, fourth, etc., harmonics are missing. In a closed pipe, odd harmonics are present. Although the open end of a combustor typically cannot be considered particularly narrow compared to the length of the sound wave produced therein (one of the assumptions in most elementary analyses of standing waves in air columns), generally, a displacement antinode of the sound wave will still lie fairly close to the open end of the combustor housing.

According to the invention, a combustor comprises a housing having a generally cylindrical sidewall, a first end and a second, open end. A nozzle assembly mixes combustion supporting materials in appropriate proportions to support combustion. The nozzle is mounted adjacent the first end. Means are provided for igniting the mixed combustion supporting materials. At least one opening is provided through the sidewall between the first end and the second end.

Illustratively, according to the invention, there are multiple openings and the largest cross sectional dimension of each of the openings is less than about five percent of the largest cross sectional dimension of the second end. Illustratively, the largest cross sectional dimension of each of the openings is less than or equal to about two percent of the largest cross sectional dimension of the second end.

Further, illustratively, the openings are spaced at substantially equal intervals around the sidewall transverse to a longitudinal extent of the sidewall.

Additionally, illustratively, the sidewall is generally right circular cylindrical.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
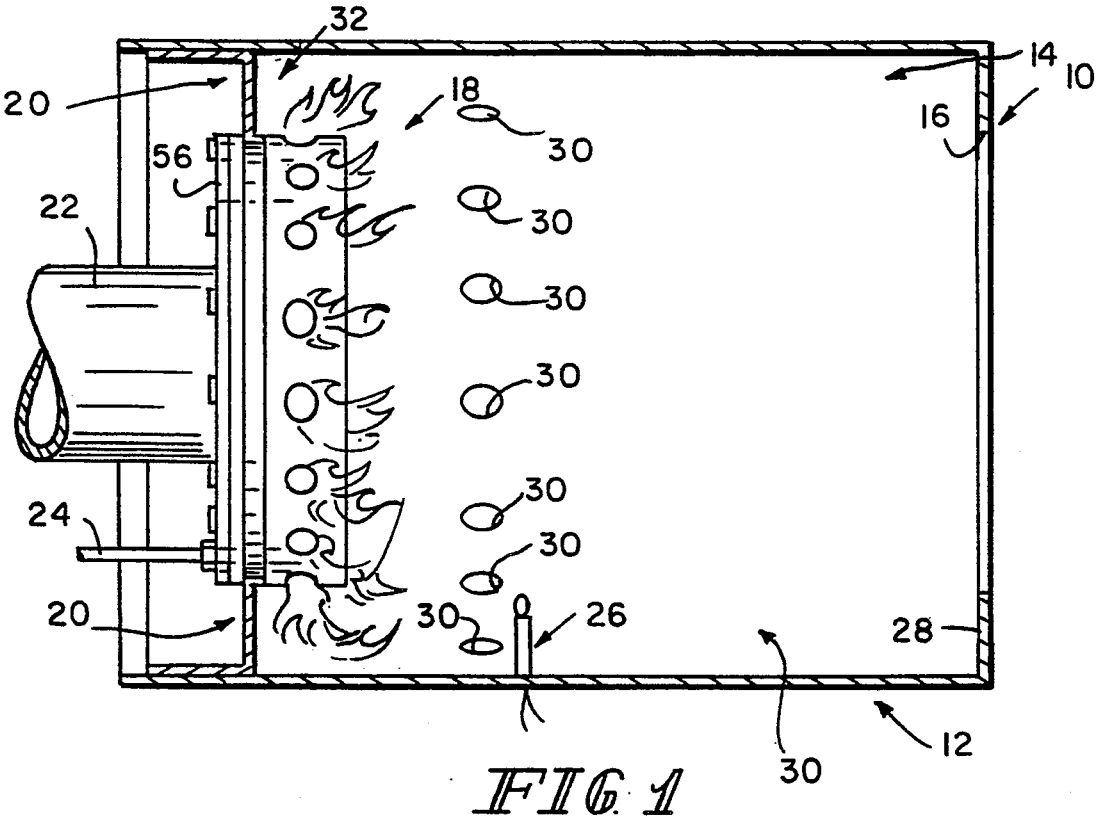
FIG. 1 illustrates a longitudinal sectional side elevational view of a combustor provided with tuning holes; and, FIG. 2 illustrates a longitudinal sectional side elevational view of another combustor provided with tuning holes.

Referring to FIG. 1, a combustor assembly 10 includes a cylindrical housing 12 providing a combustion chamber 14 of length L and an exhaust outlet 16, a nozzle assembly 18, a nozzle support bracket 20, a combustion air supply line 22, and a fuel supply line 24. In this connection, it should be understood that "cylindrical," as used in this application, is used in its mathematical sense, that is, to define a structure generated by moving a line in a closed path parallel to another line. Consequently, the cylinders need not necessarily be right circular cylinders. They could instead be any other suitable shape. The nozzle assembly 18 mixes combustion air supplied through line 22 and fuel supplied through line 24 to produce a combustible air and fuel mixture that is discharged into combustion chamber 14. An igniter 26 of any suitable type is used to ignite the air and fuel mixture in the combustion chamber 14.

A combustion noise suppression system for combustor assembly 10 includes a number of holes 30 formed in housing 12 at a distance L/3 from the plane 32 at which the air and fuel mixture is introduced into the housing 12 and ignited to produce flame. Preferably, the diameter of each hole 30 is about two percent of the internal diameter of the housing 12.

Figure 2:
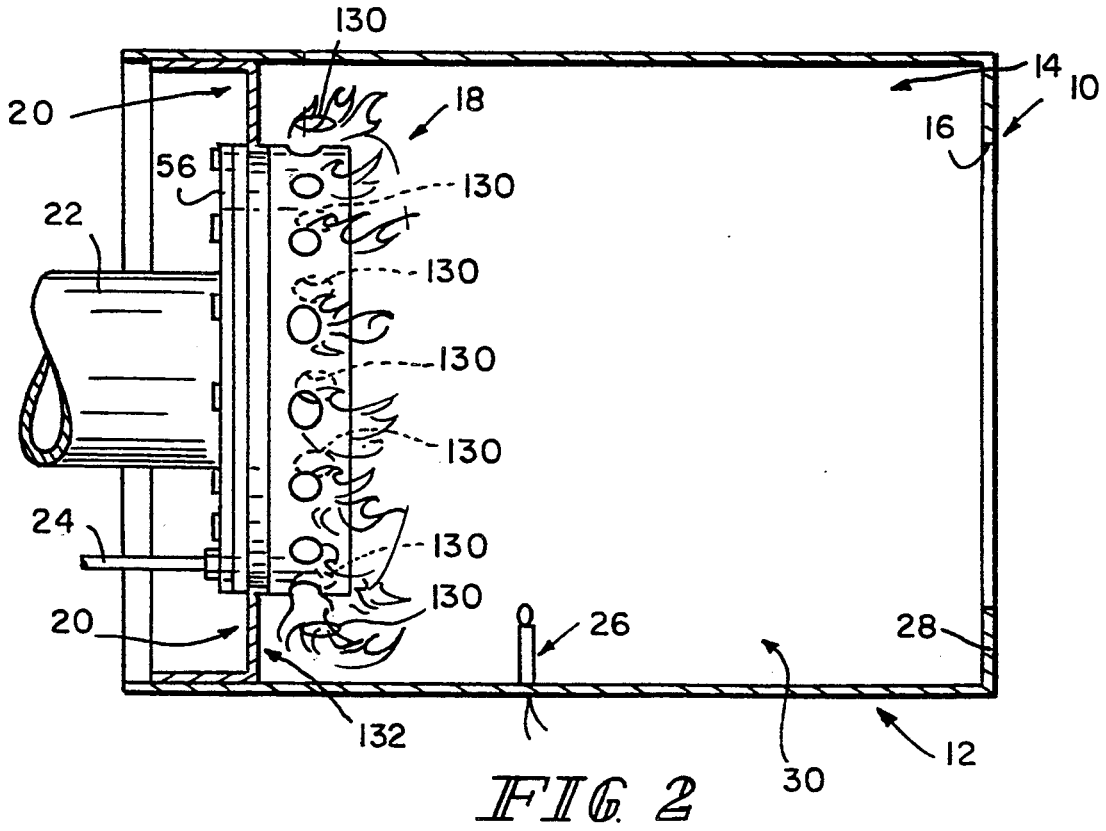

Referring to FIG. 2, another housing 112 is illustrated wherein several holes 130 are located within the first ten percent $$\left(\leqq \frac{L'}{10}\right)$$

of the axial length L' of the housing 112, referenced from the nozzle end 132 of housing 112. The holes can also be placed elsewhere along the housing with reasonable effect. No significant air or fuel/air mixture flows through these holes in either direction, so the combustion mixture is relatively unaffected by the presence of holes 30, 130. Greater noise damping is achieved by increasing the number of holes.

Although the invention has been described in detail with reference to certain preferred embodiments and specific examples, variations and modifications exist within the scope and spirit of the invention as described and defined in the following claims.

What is claimed is:

1. A combustor comprising a housing having a generally cylindrical sidewall, a first closed end and a second, open end, a nozzle assembly for mixing combustion supporting materials in appropriate proportions to support combustion and having an annular arrangement of openings in a common plane for discharging a combustible mixture toward said sidewall of said housing, means for mounting the nozzle assembly adjacent the first end, means for igniting the mixed combustion supporting materials, said housing having a single row of combustion noise attenuating openings around the sidewall between the first end and the second end, the plurality of combustion noise attenuating openings consisting of openings substantially equally spaced about said housing and lying generally in a plane perpendicular to a longitudinal extent of the sidewall and downstream of said nozzle, and wherein the largest cross sectional dimensions of each of the openings in said sidewalls being less than about five percent of the largest cross sectional dimension of the second end.

2. The apparatus of claim 1 wherein the largest cross sectional dimension of each of the openings is less than or equal to about two percent of the largest cross sectional dimension of the second end.

3. The apparatus of claim 1 or 2 wherein the sidewall is generally right circular cylindrical.

* * * * *